US007568453B2

(12) United States Patent
Ångström

(10) Patent No.: US 7,568,453 B2
(45) Date of Patent: Aug. 4, 2009

(54) TWO-STROKE ENGINE WITH VARIABLE COMPRESSION

(75) Inventor: Hans-Erik Ångström, Huddinge (SE)

(73) Assignee: HCCI Technology AB, Stockholm (SE)

( * ) Notice: Subject to any disclaimer, the term of this patent is extended or adjusted under 35 U.S.C. 154(b) by 0 days.

(21) Appl. No.: 11/991,176

(22) PCT Filed: Sep. 4, 2006

(86) PCT No.: PCT/SE2006/050311

§ 371 (c)(1),
(2), (4) Date: Apr. 7, 2008

(87) PCT Pub. No.: WO2007/030076

PCT Pub. Date: Mar. 15, 2007

(65) Prior Publication Data

US 2008/0223342 A1 Sep. 18, 2008

(51) Int. Cl.
*F02B 75/04* (2006.01)
*F01B 7/14* (2006.01)

(52) U.S. Cl. ..... 123/48 B; 123/78 F; 123/51 BA

(58) Field of Classification Search ..... 123/48 R, 123/48 B, 78 F, 51 R, 51 B, 51 BA, 51 BB, 123/51 BD See application file for complete search history.

(56) References Cited

U.S. PATENT DOCUMENTS 2,199,625 A * 5/1940 Fiala-Fernbrugg ..... 123/51 AA

FOREIGN PATENT DOCUMENTS

| | | |
|---|---|---|
| GB | 662056 | 11/1951 |
| JP | 63154821 | 6/1988 |
| WO | 8805862 | 8/1988 |

OTHER PUBLICATIONS

English Abstract of JP 6315481.

* cited by examiner

*Primary Examiner*—Noah Kamen
(74) *Attorney, Agent, or Firm*—Dykema Gossett PLLC

(57) ABSTRACT

The invention consists of a two-stroke opposing cylinder engine that includes a length flushing system and two crankshafts (1, 3) and a novel type of phase setting mechanism which enables the compression ratio to be adjusted in operation. Two intermediate gear wheel (15) and (16) synchronize rotation of the crankshafts (1, 3). The centre positions of the two intermediate gear wheels (15, 16) are moved by means of a setting device (21) so as to change the phase position between the crank shafts (1, 3) and therewith the compression. With the aid of the two intermediate gear wheels (15, 16) the crankshafts will rotate in mutually opposite directions, therewith eliminating torque-dependent vibrations.

7 Claims, 3 Drawing Sheets

TWO-STROKE ENGINE WITH VARIABLE COMPRESSION

TECHNICAL FIELD

The present invention relates to the field of internal combustion engines and then particularly to techniques of achieving controllable compression ratios. The present invention also solves the problems of vibration in respect of such internal combustion engines.

BACKGROUND OF THE INVENTION

The internal combustion engine generally predominates as a prime mover in auto-vehicles, motorboats and portable electrical power plants.

Strenuous efforts are being made to reduce the emissions and to increase engine efficiencies.

The value of higher efficiencies increases with the growing scarcity of engine fuel, coupled with higher fuel costs. Another reason for endeavouring to achieve improved efficiencies is because of the increasing greenhouse effect, which can be alleviated to some extent with improved engine efficiencies. Moreover, biological fuels capable of replacing fossil fuels will always be a scarce resource.

The Otto engine has low exhaust emissions as a result of successful catalyst technology although it also has a low efficiency, particularly at partial loads. The reason for this low efficiency is because of the necessity to restrict the compression ratio due to the need of preventing self-ignition (knocking). Throttling losses occur at partial loads, these losses normally being accompanied by high percentages of frictional losses, due to the fact that the engine is normally relatively large in relation to the average power taken from the engine.

Although the diesel engine has a satisfactory efficiency it also has the problem of particle and NOx-emissions.

Although it is possible to reduce these emissions, the costs involved and the ensuing problems concerning the reliability of the engine in operation cause the diesel engine to be viewed less attractively.

As a result, research scientists have become very interested in the use of homogenous compression ignition combustion (HCCI) as a method of dealing with NOx and particle-free combustion, CO and HC emissions with the aid of a simple oxidizing catalyst. The compression ratio will then suitably be such as to cause the point of ignition to lie in the proximity of that obtained in the compression ratio used in the case of diesel engines, resulting in highly efficient internal combustion engines. Combustion will also be rapid, regardless of speed-dependent turbulence. Although this rapid combustion is favourable with respect to efficiency, it is problematic with respect to noise and with respect to the permitted maximum fuel consumption per combustion cycle. Consequently, an HCCI-engine will normally have a lower maximum power output than a conventional engine.

The HCCI-combustion process can be controlled with a variable compression ratio or variable valve times. Both methods incur considerably more expense if the measures undertaken shall be added to an existing engine concept.

Vibrations are another problem incurred by piston engines. There are, in principle, two different causes for these disturbing vibrations, the best known being. the result of the acceleration of the pistons and the accompanying part of the crankshaft. The method of eliminating this vibration, which has a force amplitude that is quadratic with respect to engine speed, is to include many cylinders or balance shafts in the case of engines that have fewer than six cylinders. A four-cylinder engine with double the number of counter-rotating balance shafts is, in principle, fully balanced with respect to this vibration.

The other type of vibration is amplitude-independent of the speed. This is due to the necessity of slowing down the flywheel crankshaft in order to obtain the compression work that imparts a torque amplitude to the engine body. Subsequent to combustion, the crankshaft will be accelerated under the influence of the useful work obtained from the expansion of the combustion gas with a further torque impulse on the engine body as a result. The above problem can also be lessened in this case by including many cylinders. Distinct from the vibrations caused by piston acceleration, it is not possible to eliminate these vibrations irrespective of the number of cylinders that are provided on a common crankshaft. These torque vibrations impair engine operation at high torques on very low engine speeds. This drop in engine performance is, however, the most energy effective at low power outputs.

Patent specification WO88/05862 teaches an internal combustion engine that includes counter-acting cylinders whose crankshafts are synchronized with the aid of a fixed gear wheel system that includes two gear wheels and two intermediate gear wheels on fixed bearing axles. One crank-shaft mounted gear wheel of the gear wheel system is arranged to allow its angle relative to its crankshaft to be changed so as to alter its phase position, through the medium of a separate operating device which is arranged as a harmonic gear or as a variable splined coupling, or as an additional operating device for changing the relative angular position of two shafts between two conical gears.

OBJECT OF THE INVENTION

The object of the present invention is to enable the compression ratio to be controlled economically while enabling both of the vibration modes described above to be eliminated generally with the aid of solely one cylinder.

The engine configuration can be used as an Otto engine with or without being supercharged such as to always optimize efficiency and avoid knocking as a result of compression adjustment.

The engine configuration can be used as a Otto engine, with or without being supercharged, so that the engine can always be started and will always perform with optimal efficiency as a result of said compression adjustment with the engine adapted for different cetane numbers and limited stresses. The cetane number can be measured on a running engine by measuring the ignition delay.

The engine configuration can be used as an HCCI-engine, with or without being supercharged, so as to control the ignition timing as a result of the compression adjustment.

The engine configuration can be used as a partial HCCI-engine, with or without being supercharged, so as to enable the ignition timing to be controlled as a result of the compression adjustment and to enable the mode of the engine to be switched readily to an Otto mode or a diesel mode at higher loads.

In the case of HCCI-operation it is possible to save rest gases in a manner which is effective with regard to efficiency.

In the case of HCCI-operation of high power output the engine should be suitable for high speeds, due to its effective counter balancing, the absence of valve systems and the provision of a favourable flushing system. In this operating mode, the rapid HCCI-combustion at low rest gases can only be of benefit.

Thus, the engine is able to provide an unbeatable large operating range of high efficiency. This means that in the case of a hybrid vehicle it should be possible to keep the conversion losses in respect of charging and discharging batteries at a much lower level than in the case of conventional engines wherewith the inventive engine concept greatly improves the fuel economy.

DESCRIPTION OF THE INVENTION

Figure 1:
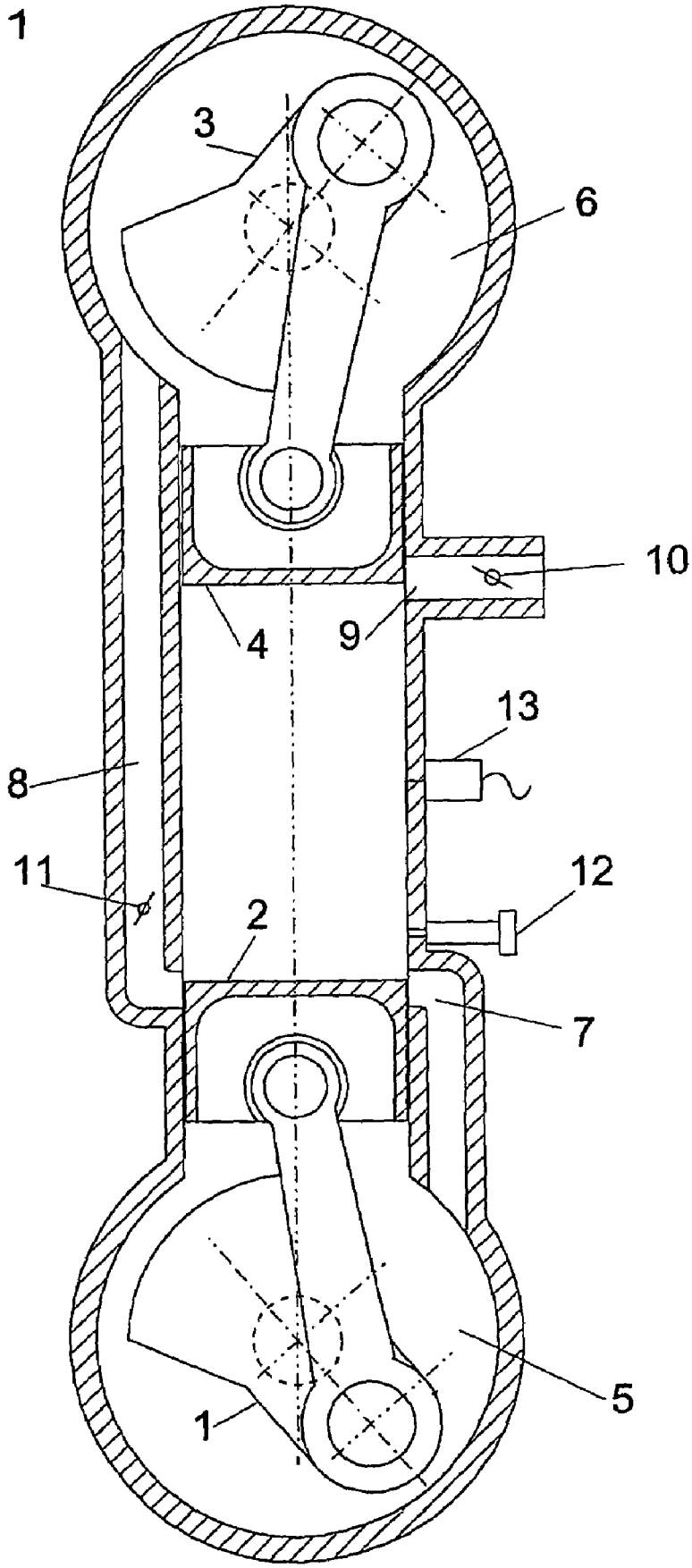
FIG. 1 illustrates a section of the cylinder and shows details of the exhaust port and the flushing ports.

According to the invention, the engine is of the opposed-cylinder type; see FIG. 1. The engine has two crankshafts 1 and 3 and associated pistons 2 and 4. Rotation of the crankshafts 1 and 2 is synchronized by the gearing shown in FIGS. 2 and 3. As a result of the provision of two intermediate gear wheels 15 and 16 the crankshafts 1 and 3 will rotate in mutually opposite directions. If it is ensured that the rotational torque on the crankshafts 1 and 3, including fixedly connected loads, such as generators for instance, are mutually the same, the engine will completely lack any moment vibrations, which is highly beneficial in respect of the majority of installations and results in smaller losses when engine movements result in power losses.

Because the pistons 2 and 4 are accelerated towards each other, vibrations resulting from the mass forces, which are greatest at high engine revolutions, will be negligible. However, a small contribution will be achieved when there is available a small phase difference for adjustment of the compression ratio.

Figure 2:
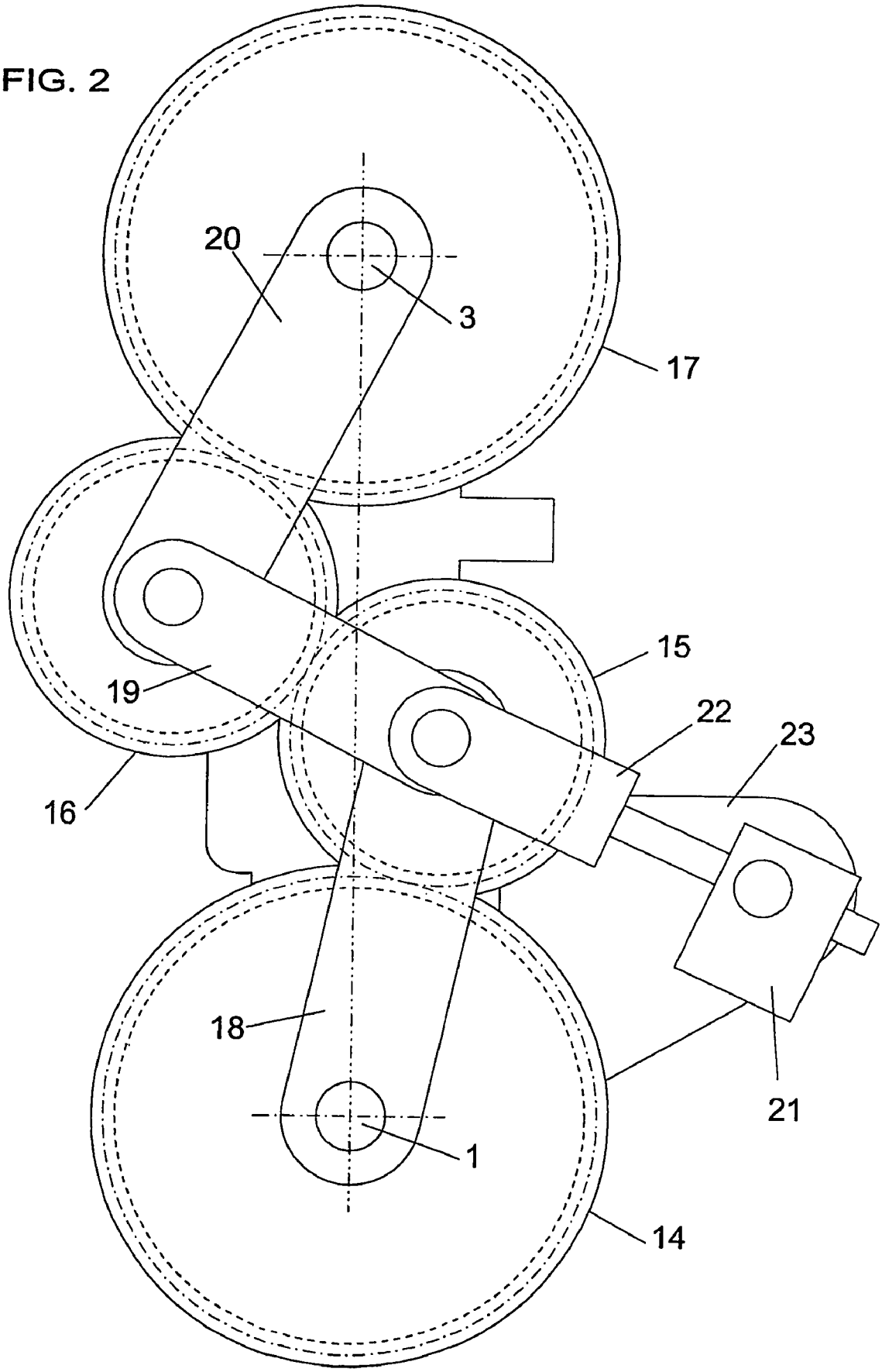
FIG. 2 illustrates the synchronizing gear and the setting device for compression control.
Figure 3:
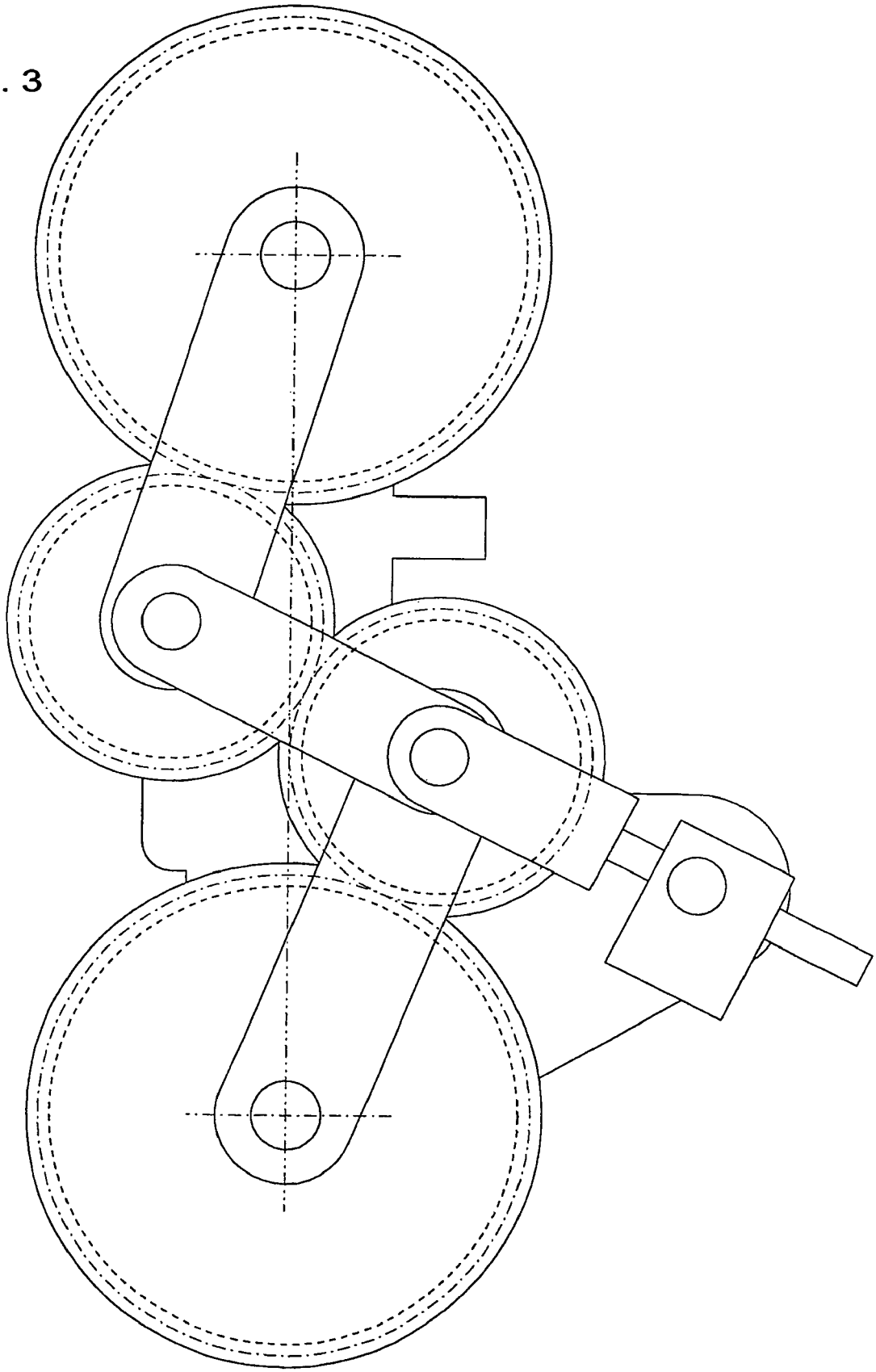
FIG. 3 illustrates the synchronization gear set for compression that is different to the setting shown in FIG. 2.

Adjustment of the compression ratio can be effected smoothly and continuously during operation, by adjusting the phase position between the crankshafts 1 and 3 in the case of the gearing shown in FIGS. 2 and 3 respectively.

Each of the crankshafts 1 and 3 include a respective gear wheel 14 and 17 of mutually the same size, in accordance with FIG. 2. The gear wheel 14 is in constant engagement with the gear wheel 15, which is suspended on a link arm 18 that is movable about a centre on the gear wheel 14. Similarly, the gear wheel 17 is in engagement with the gear wheel 16 which is suspended in a link 20 that is movable about the centre of the gear wheel 17. The pair of gear wheels 15 and 16 are constantly in engagement with one another due to the link 19 that holds the pair together. The phase position between the crankshafts can be set, by moving the centre points of the pair of gear wheels 15 and 16 by means of the setting device 21. The setting device 21 is attached in the body of the engine via the bracket 23 and is fastened in the pair of gear wheels 15 and 16 via the link 22. FIGS. 2 and 3 illustrate two different settings of the phase position. The crankshafts can also be synchronized with the aid of gearing in which the gear wheels 15 and 16 have mutually different sizes, since the peripheral speed of the gear wheels will nevertheless be the same as the peripheral speed of the gear wheels 14 and 17. This design can be beneficial from the aspect of a built-in construction.

The phase adjusting mechanism can be used for purposes other than that of setting the phase position between crankshafts. For instance, the phase adjusting mechanism may be used to adjust the camshafts of internal combustion engines or in respect of general machine constructions.

The engine principle may be an Otto engine with spark plug ignition, wherein reference 13 in FIG. 1 indicates a sparkplug.

The engine principle may be a diesel engine with direct injection, wherein the reference numeral 13 in FIG. 1 indicates an injector.

The engine principle may be an HCCI-engine wherein the reference numeral 13 in FIG. 1 corresponds to a sensor for indicating the ignition firing status. The sensor may, for instance, be a pressure sensor, an accelerometer or a force or strain gauge.

The HCCI-variant will be described hereinafter in more detail with reference to an imaginary or contemplated design that exemplifies the general engine construction.

The phase adjustment is used in this case to set the point of ignition at a desired crank angle regardless of engine speed, load, engine temperature, fuel type, air suction temperature or pressure. The ignition point is suitably controlled with feedback from a measured ignition point.

The exemplifying engine is also provided with a rapidly moving throttle valve 10 in the exhaust port 9 so as to enable the volume of rest gas to be controlled rapidly should it become necessary to change the ignition point more rapidly than what the setting motor 21 can achieve, or for other reasons in controlling the volume of rest gas.

The engine is a length-flushed two-stroke type of engine. The pressure in the cylinder will rapidly fall after the working rate results in opening the exhaust port 9, which may be one or more in number. The overflow ports open after a given crank angle is reached. In this case the overflow ports are symbolised by reference numerals 7 and 8, although there may be more such ports than is shown. The exhaust gases that remain after this drop in pressure are dispelled by the fresh gases that are delivered via the overflow ports. The pressure driving the flow in through the overflow ports may originate from the crank housings 5 and 6, which then function as typical flush pumps, or from separate flush pumps. Depending on the magnitude on the flow that is pumped in via the flushing ports and influenced by the mixing phenomenon in the cylinder, a certain amount of hot rest gases will remain in the cylinder until the next combustion phase. The amount of rest gases that remain will influence the phase of the combustion and also the speed of combustion. A large volume of rest gases result in a calmer combustion process, which is beneficial with respect to the HCCI-engine at low rpm.

In the case of low loads, for instance a hybrid vehicle application, the flow from the crank housing 6 can be reduced or cut-off completely with the aid of the valve 11. When the overflow channel 8 is fully shut off, pump losses from pumping the crank housing 6 will be very small. Compression then takes place in the crank housing 6 with a following expansion phase up to the proximity of the starting pressure. This operating mode enables the achievement of high efficiency at low loads.

Conventional methods known from two stroke-engines can be used for refilling the crank houses with fresh gas. Such methods include the use of plunger controlled ports, reed valves, and slide valves.

Fuel is suitably supplied by injection with the aid of the injector 12. Alternatively, a fuel mixture may be prepared prior to forcing combustion air into the cylinder, for instance by channel injection or via a carburetor. The natural option will then be solely to provide one crank housing with a fuel mixture, wherewith the overflow channel from the other crank housing will contain solely air. This may provide grounds for offsetting crank angle of the overflow ports from the two crank housings. This flushing method enables the exhaust gases and the fresh gases to be layered in the cylinder. In addition, it is also possible to layer two types of flushing medium. The flushing medium may be pure air, a fuel-air mixture, air mixed with chilled EGR gas, pure EGR-gas or mixtures of mutually different temperatures for the different crank housings. Layering may be highly beneficial in the HCCI-context. For instance, excessively lean mixtures have low combustion efficiencies. Inhomogeneous conditions are able to result in slower and calmer combustion.

The phase position between the crankshafts 1 and 3 is regulated to set the compression ratio to a desired level. It is possible to achieve a nominal phase displacement so that the crankshaft that controls opening of the exhaust port lies before the crankshaft that controls opening of the overflow ports. The reason for this may be to close the exhaust port or the exhaust ports earlier than in the case of symmetry, perhaps prior to the overflow ports. Early closing of the exhaust port makes filling of the cylinder more effective in the case of supercharging the engine.

A change in the phase of the crankshafts in order to set the compression ratio will influence the exhaust port timing in comparison with the overflow port timing. Consequently, it is necessary to search for a comprise that covers the entire operating area.

The invention claimed is:

1. A two-stroke opposing cylinder engine that has two crankshafts (1, 3) which are each connected to a respective crankshaft gear wheel (14, 17) each of which engages an intermediate gear wheel (15, 16) which are, in turn, engaged with each other for synchronizing movements of the crankshafts (1, 3) and wherein centre positions of the two intermediate gearwheels (15, 16) are adapted for common displacement so as to achieve an adjustable compression ratio through the medium of an adjustable phase position between the two crankshafts (1, 3).

2. An engine according to claim 1, wherein the centre positions of the two intermediate gearwheels (15,16) are placed on a link (19) that holds said intermediate gear wheels together.

3. An engine according to claim 2, wherein a setting device (21) is connected to the link (19) for displacement of said link.

4. An engine according to claim 3, wherein the crankshafts (1, 3) rotate in mutually opposite directions.

5. An engine according to claim 1, including a crank housing flushing system to be opened for flushing purposes or to be closed by means of a valve means (11) disposed between said crank housing and the port opening.

6. An engine according to claim 1, wherein nominal phase position between the crankshafts (1, 3) is set so that an exhaust gas port (9) will close earlier in comparison with symmetrical port times.

7. An engine according to claim 6, wherein the nominal phase position between the crankshafts (1,3) is such that the exhaust gas port (9) will close earlier than overflow ports (7, 8).

* * * * *